US009649748B2

(12) United States Patent
Konovalov et al.

(10) Patent No.: US 9,649,748 B2
(45) Date of Patent: May 16, 2017

(54) POLYCRYSTALLINE DIAMOND COMPACT WITH A MODIFIED SUBSTRATE

(71) Applicant: DIAMOND INNOVATIONS, INC., Worthington, OH (US)

(72) Inventors: Valeriy Konovalov, Lewis Center, OH (US); Abhijit Prabhakar Suryavanshi, Columbus, OH (US)

(73) Assignee: DIAMOND INNOVATIONS, INC, Worthington, OH (US)

( * ) Notice: Subject to any disclaimer, the term of this patent is extended or adjusted under 35 U.S.C. 154(b) by 26 days.

(21) Appl. No.: 14/705,172

(22) Filed: May 6, 2015

(65) Prior Publication Data

US 2015/0321318 A1 Nov. 12, 2015

Related U.S. Application Data

(60) Provisional application No. 61/989,558, filed on May 7, 2014.

(51) Int. Cl.

| | |
|---|---|
| ***E21B 10/00*** | (2006.01) |
| ***E21B 10/46*** | (2006.01) |
| ***B24D 3/06*** | (2006.01) |
| ***B24D 18/00*** | (2006.01) |
| ***B24D 99/00*** | (2010.01) |
| *B01J 3/00* | (2006.01) |
| *C23C 28/00* | (2006.01) |

(52) U.S. Cl.
CPC ..... *B24D 3/06* (2013.01); *B24D 18/0009* (2013.01); *B24D 99/005* (2013.01)

(58) Field of Classification Search
CPC ... E21B 10/00; E21B 10/46; B01J 3/00; B01J 3/06; C23C 16/30; C23C 16/20; C23C 28/00
See application file for complete search history.

(56) References Cited

U.S. PATENT DOCUMENTS

| | | | |
|---|---|---|---|
| 3,147,542 | A | 9/1964 | Boeckeler |
| 3,551,991 | A | 1/1971 | Reich et al. |
| 6,042,463 | A | 3/2000 | Johnson et al. |
| 8,071,173 | B1 | 12/2011 | Sani |
| 8,440,303 | B2 | 5/2013 | Mukhopadhyay et al. |
| 2006/0266558 | A1* | 11/2006 | Middlemiss ..... B22F 7/062 175/426 |
| 2009/0152018 | A1 | 6/2009 | Sani |
| 2010/0282519 | A1 | 11/2010 | Zhang et al. |
| 2011/0052931 | A1* | 3/2011 | Morton ..... C23C 30/005 428/552 |
| 2011/0283628 | A1 | 11/2011 | Saridikmen et al. |
| 2012/0138370 | A1 | 6/2012 | Mukhopadhyay et al. |
| 2012/0225253 | A1 | 9/2012 | Digiovanni et al. |

FOREIGN PATENT DOCUMENTS

| | | | |
|---|---|---|---|
| EP | 1958688 | A1 | 8/2008 |

* cited by examiner

*Primary Examiner* — Pegah Parvini

(57) ABSTRACT

A superabrasive compact and a method of making the superabrasive compact are disclosed. A method of making a superabrasive compact may comprise steps of treating a substrate to remove a first binder material from a portion of the substrate; introducing a first material into the portion of the substrate, forming a first modified substrate; and treating the porting of modified substrate to remove at least a part of the first material to form a second modified substrate.

27 Claims, 7 Drawing Sheets

POLYCRYSTALLINE DIAMOND COMPACT WITH A MODIFIED SUBSTRATE

CROSS-REFERENCE TO RELATED APPLICATIONS

The present application claims the benefit of U.S. Provisional Application No. 61/989,558, filed May 7, 2014, the entire disclosure of which is hereby incorporated by reference.

TECHNICAL FIELD AND INDUSTRIAL APPLICABILITY

The present invention relates generally to superabrasive materials and a method of making superabrasive materials, and more particularly, to polycrystalline diamond compacts (PCD) with high temperature resistance.

SUMMARY

In one embodiment, a method of making a superabrasive compact may comprise steps of treating a substrate to remove a first binder material from a portion of the substrate; introducing a first material into the portion of the substrate, forming a first modified substrate; and treating the porting of the first modified substrate to remove at least a part of the first material to form a second modified substrate.

In another embodiment, a method of making a superabrasive compact may comprise steps of treating a substrate to remove a binder material from a portion of the substrate; introducing a first material into the portion of the substrate, forming a first modified substrate; providing an at least partially leached polycrystalline diamond table near the first modified substrate; and subjecting the first modified substrate and the at least partially leached polycrystalline diamond table to conditions of an elevated temperature and pressure suitable for producing the polycrystalline superabrasive compact.

In yet another embodiment, a method of making a superabrasive compact may comprise steps of treating a substrate to remove a binder material from a first portion of the substrate; introducing a first material into the first portion of the substrate, forming a first modified substrate; introducing a second material into a second portion of the substrate, forming a second modified substrate; providing a diamond volume adjacent to the substrate; and subjecting the substrate and the diamond volume to conditions of an elevated temperature and pressure suitable for producing the polycrystalline superabrasive compact.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
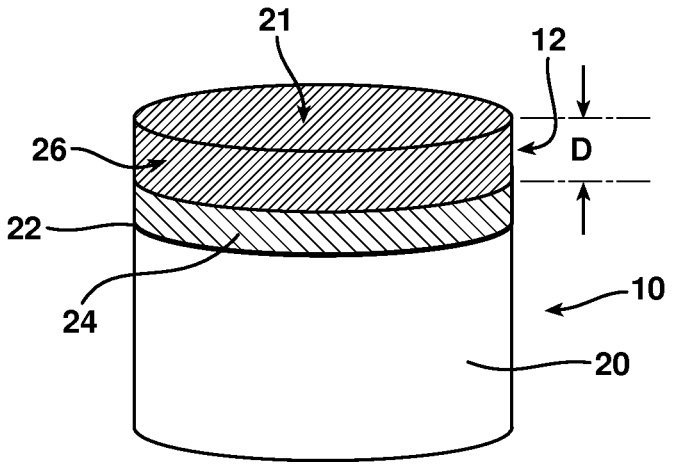
FIG. 1 is a schematic perspective view of a cylindrical shape thermally stable polycrystalline diamond compact produced in a high pressure high temperature (HPHT) process according to an embodiment.

Before the description of the embodiment, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50% means in the range of 45%-55%.

As used herein, the term "superabrasive particles" may refer to ultra-hard particles or superabrasive particles having a Knoop hardness of 3500 KHN or greater. The superabrasive particles may include diamond and cubic boron nitride, for example. The term "abrasive", as used herein, refers to any material used to wear away softer materials.

The term "particle" or "particles", as used herein, refers to a discrete body or bodies. A particle is also considered a crystal or a grain.

The term "superabrasive compact", as used herein, refers to a sintered product made using super abrasive particles, such as diamond feed or cubic boron nitride particles. The compact may include a support, such as a tungsten carbide support, or may not include a support. The "superabrasive compact" is a broad term, which may include cutting element, cutters, or polycrystalline cubic boron nitride insert.

The term "cutting element", as used herein, means and includes any element of an earth-boring tool that is used to cut or otherwise disintegrate formation material when the earth-boring tool is used to form or enlarge a bore in the formation.

The term "earth-boring tool", as used herein, means and includes any tool used to remove formation material and form a bore (e.g., a wellbore) through the formation by way of removing the formation material. Earth-boring tools include, for example, rotary drill bits (e.g., fixed-compact or "drag" bits and roller cone or "rock" bits), hybrid bits including both fixed compacts and roller elements, coring bits, percussion bits, bi-center bits, reamers (including expandable reamers and fixed-wing reamers), and other so-called "hole-opening" tools.

The term "feed" or "diamond feed", as used herein, refers to any type of diamond particles, or diamond powder, used as a starting material in further synthesis of PDC compacts.

The term "non-binder" material, as used herein, may refer to any material, metallic elements, non-metal, or semiconductor materials, which do not involve or help tungsten carbide substrate's chemical formation.

The term "polycrystalline diamond", as used herein, refers to a plurality of randomly oriented or highly oriented monocrystalline diamond particles, which may represent a body or a particle consisting of a large number of smaller monocrystalline diamond particles of any sizes. Polycrystalline diamond particles usually do not have cleavage planes.

The term "superabrasive", as used herein, refers to an abrasive possessing superior hardness and abrasion resistance. Diamond and cubic boron nitride are examples of superabrasives and have Knoop indentation hardness values of over 3500.

The terms "diamond particle" or "particles" or "diamond powder", which is a plurality of single crystals or polycrystalline diamond particles, are used synonymously in the instant application and have the same meaning as "particle" defined above.

Polycrystalline diamond compact (or "PCD", as used hereinafter) may represent a volume of crystalline diamond grains with embedded foreign material filling the inter-grain space. In one particular case, a compact comprises crystalline diamond grains, bound to each other by strong diamond-to-diamond bonds and form a rigid polycrystalline diamond body, and the inter-grain regions, disposed between the bounded grains and filled in one part with a catalyst material (e.g. cobalt or its alloys), which was used to promote diamond bonding during fabrication, and other part filled in other materials which may remain after the sintering of diamond compact. Suitable metal solvent catalysts may include the iron group transitional metals in Group VIII of the Periodic table.

"Thermally stable polycrystalline diamond," as used herein, is understood to refer to intercrystalline bonded diamond that includes a volume or region that is or that has been rendered substantially free of the solvent metal catalyst or binder used to form PCD, or the solvent metal catalyst or binder used to form PCD remains in the region of the diamond body but is otherwise reacted or otherwise rendered ineffective in its ability adversely impact the bonded diamond at elevated temperatures as discussed above.

In one embodiment, a polycrystalline diamond composite compact includes a plurality of crystalline diamond grains, which are not bound to each other, but instead are bound together by foreign bonding materials such as borides, nitrides, carbides, and others, e.g. by silicon carbide bonded diamond material.

Polycrystalline diamond compacts (or PCD compacts) may be fabricated in different ways and the examples discussed herein do not limit a variety of different types of diamond composites and PDC compacts which may be produced according to an embodiment. In one embodiment, polycrystalline compacts may be formed by placing a mixture of diamond powder with a suitable solvent catalyst material (e.g. cobalt powder) on the top of WC—Co substrate, the assembly is then subjected to conditions of HPHT process, where the solvent catalyst promotes desired intercrystalline diamond-to-diamond bonding resulted in the formation of a rigid polycrystalline diamond body and, also, provides a binding between polycrystalline diamond body and WC—Co substrate.

In another embodiment, a polycrystalline diamond compact is formed by placing diamond powder without a catalyst material on the top of substrate containing a catalyst material (e.g. WC—Co substrate). In this example, necessary cobalt catalyst material is supplied from the substrate and melted cobalt is swept through the diamond powder during the HPHT process. In still another embodiment, a hard polycrystalline diamond composite compact is fabricated by forming a mixture of diamond powder with silicon powder and the mixture is subjected to an HPHT process, thus forming a dense polycrystalline compact where diamond particles are bound together by newly formed silicon carbide material.

The presence of catalyst or binder materials inside the polycrystalline diamond body promotes the degradation of the cutting edge of the compact during the cutting process, especially if the edge temperature reaches a high enough critical value. It is theorized that the catalyst driven degradation may be caused by the large difference in coefficient of thermal expansion between diamond and catalyst (e.g. cobalt metal), and also by the catalytic effect of the catalyst on diamond graphitization. Removal of catalyst from the polycrystalline diamond body of PDC compact, for example, by chemical leaching in acids, leaves an interconnected network of pores and residual catalyst (up to about 10 vol %) trapped inside the polycrystalline diamond body. It has been demonstrated that depletion of catalyst from the polycrystalline diamond body of the PDC compact may significantly improve a compact's abrasion resistance. Thus, it is theorized that a thicker depleted catalyst layer near the cutting edge, such as more than about 100 μm, may provide better abrasion resistance of the PDC compact than a thinner depleted catalyst layer, such as less than about 100 μm.

A superabrasive compact 10 in accordance with an embodiment is shown in FIG. 1. Superabrasive compact 10 may be coupled to a suitable tool, such as a drill bit that is used in a downhole drilling application, for example. One example of the superabrasive compact 10 may include a diamond table 12 having a top surface 21.

In one embodiment, the superabrasive compact may be a standalone diamond table without a substrate. In another embodiment, the superabrasive compact 10 may include a substrate 20 attached to the diamond table 12 formed by polycrystalline diamond particles. The substrate 20 may include a metal carbide, and may be attached to the diamond table 12. Substrate 20 may be made from cemented cobalt tungsten carbide, while the diamond table 12 may be formed from a polycrystalline ultra-hard material, such as polycrystalline diamond or diamond crystals bonded by a foreign material.

Still referring to FIG. 1, the diamond table 12 may include at least two regions including a first region 26 and a second region 24. An interface 22 may exist between the first region 26 and the second region 24. The interface 22 may be an uneven interface. The second region 24 may be positioned between and contacting the substrate 20 and the first region 26.

The compact 10 may be referred to as a polycrystalline diamond compact ("PCD") when polycrystalline diamond is used to form the diamond table 12. PCD compacts are known for their toughness and durability, which allow them to be an effective cutter in demanding applications. Although one type of superabrasive compact 10 has been described, other types of superabrasive compacts 10 may be utilized. For example, in one embodiment, superabrasive compact 10 may have a chamfer (not shown) around an outer perimeter of the top surface 21. The chamfer may have a vertical height of about 0.5 mm or 1 mm and an angle of about 45° degrees relative to the top surface 21 of the compact 10, for example, which may provide a particularly strong and fracture resistant tool component. The superabrasive compact 10 may be a subject of procedure depleting catalyst metal (e.g. cobalt) near the cutting surface of the compact, for example, by chemical leaching of cobalt in acidic solutions. The unleached superabrasive compact may be fabricated according to processes known to persons having ordinary skill in the art. Methods for making diamond compacts and composite compacts are more fully described in U.S. Pat. Nos. 3,141,746; 3,745,623; 3,609,818; 3,850,591; 4,394,170; 4,403,015; 4,794,326; and 4,954,139.

Figure 2:
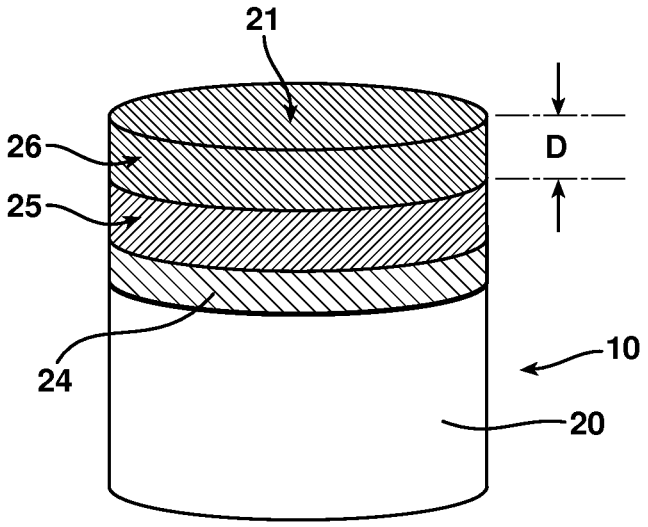
FIG. 2 is a schematic side view of a cylindrical shape thermally stable polycrystalline diamond compact produced in a high pressure high temperature (HPHT) process according to another embodiment.

In certain applications, it may be desired to have a PCD body that includes a single PCD-containing volume or region, while in other applications, it may be desired that a PCD body be constructed having two or more different PCD-containing volume or regions. For example, it may be desired that the PCD body include a first PCD-containing region 26 extending a distance D from the top surface or a working surface 21, as shown in FIG. 1, and a second PCD-containing region 24 extending from the first PCD-containing region to the substrate. Alternatively, as shown in FIG. 2, the PCD body may further include a third PCD-containing region 25 between the first PCD-containing region 26 and the second PCD-containing region 24. The PCD-containing regions may be formed having different diamond densities and/or be formed from different diamond grain sizes, and/or be formed from leaching the PCD partially or fully with acid solutions, and/or be formed from different fillers in the interstitial channels. In one embodiment, the interstitial channels may be filled in by aluminum carbide, for example, in the region 26. The interstitial channels in the region 25 may be filled in by a braze alloy, such as Ticusil® or Ticusil® components, such as Ti, copper, or silver, or titanium carbides. The interstitial channels in the region 24 may be filled in by a binder material, such as Co, Fe, or Ni or combinations thereof. It is, therefore, understood that thermally stable polycrystalline diamond constructions of the embodiment may include one or more PCD regions within the PCD body as called for by a particular drilling or cutting application.

Figure 3:
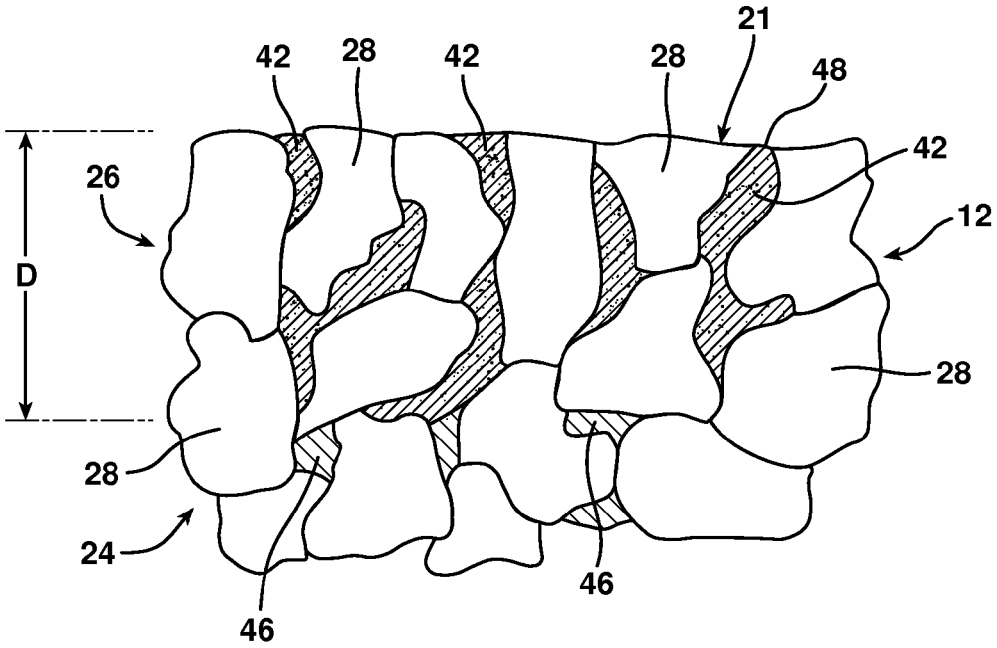
FIG. 3 is an enlarged cross-sectional view of a part of diamond table on the thermally stable polycrystalline diamond compact as shown in FIG. 1 according to an embodiment.

FIG. 3 illustrates the microstructure of the diamond table 12 as shown in FIG. 1, and more specifically, a section of the thermally stable polycrystalline diamond 10. The diamond table 12 of the thermally stable region may have the first region 26 and the second region 24. The diamond table 12 may include bonded diamond grains 28 defining interstitial channels 42. A matrix of interstitial channels 42 between the bonded diamond grains may be filled with non-binder materials or binder material in the first region. An element of the non-binder material may be from the substrate. In one embodiment, the non-binder materials may comprise silicon carbide. In another embodiment, the non-binder materials may comprise aluminum carbide, for example. In further another embodiment, the non-binder materials may comprise a braze alloy, such as Ticusil® or Ticusil® components, such as Ti, copper, or silver, or titanium carbides. The first thermally stable region comprising the interstitial regions free of the catalyst material is shown to extend a distance "D" from a working or cutting surface 21 of the thermally stable polycrystalline diamond 10. In one embodiment, the distance "D" may be identified and measured by cross sectioning a thermally stable diamond table construction and using a sufficient level of magnification to identify the interface between the first and second regions.

The so-formed thermally stable first region 26 may not be subjected to the thermal degradation encountered in the remaining areas of the PCD diamond body, resulting in improved thermal characteristics. The remaining region of the interstitial channels 42 in the second region 24 may be filled with a metal catalyst or a binder material 46. The binder material may be from the substrate.

The first region may comprise an additive, such as an inert chemical. The inert chemical may include glass or quartz. Glass filler may be chosen because glass has a low softening and melting point such that it may become liquid at relative low temperature, e.g., about 600° C. Quartz crystal may be chosen because quartz has a similar coefficient of thermal expansion (CTE) as diamond. The addition of quartz crystal may not cause thermal failure to the diamond table under high temperatures. The first region may occupy from about 20% to about 95% of the volume of the diamond table 12. In one embodiment, the diamond table may have a uniform cylindrical shape from the top to the bottom. In such embodiments, the height D of the first region may be from about 20% to about 95% the total height of the diamond table 12. In another embodiment, the height D of the first region may be from about 50% to about 95% the total height of the diamond table 12. If the diamond table is about 2 mm thick, for example, the first region 26 may be from about 1 mm to about 1.9 mm, for example.

In one embodiment, the interstitial channels 42 of the first region 26 of the diamond table 12 may have about 87.5% aluminum and about 12.5% silicon. The aluminum carbide and silicon carbide may be formed from a eutectic material comprising about 87.5% aluminum and about 12.5% silicon eutectic composition.

The diamond table 12 may be partially leached according to known methods. The selected region of the PCD body may be rendered thermally stable by removing substantially all of the catalyst or binder material therefrom by exposing the desired surface or surfaces to acid leaching, as disclosed for example in U.S. Pat. No. 4,224,380. Generally, after the PCD body or compact is made by HPHT process, the identified surface or surfaces, e.g., at least a portion of the working or cutting surfaces, are placed into contact with the acid leaching agent for a sufficient period of time to produce the desired leaching catalyst material depletion depth.

Suitable leaching agents for treating the selected region to be rendered thermally stable include materials selected from the group consisting of inorganic acids, organic acids, mixtures and derivatives thereof. The particular leaching agent that is selected may depend upon such factors as the type of catalyst material used, and the type of other non-diamond metallic materials that may be present in the PCD body, e.g., when the PCD body is formed using synthetic diamond powder. While removing the catalyst material from the selected region operates to improve the thermal stability of the selected region, it is known that PCD bodies especially formed from synthetic diamond powder may include, the binder material, such as a metal selected from the group consisting of Co, Ni, Fe, and combinations thereof, or non-binder materials, such as other metallic elements that may also contribute to thermal instability.

Graphitization of diamond grains may be reduced or eliminated in PCD materials if the binder material in PCD materials is, after sintering, replaced with a material such as an Si, aluminum, or an Si or/and aluminum alloy. Similarly, micro-cracking may be reduced by reducing the mismatch between the coefficients of thermal expansion of the diamond phase and the binder material. Both of these attributes may be accomplished by displacing the binder material with a different material or by substituting the material used as the binder material with a material having the desired physical properties. The PCD so formed may be typically bonded to a substrate either in the same process or in a subsequent process to form a superabrasive compact. Embodiments according to the present disclosure include a superabrasive compact where the PCD is bonded to a substrate containing a binder material that melts and sweeps at low temperatures as compared to melting temperatures of conventional catalyst materials.

The thermally stable PCD may be made in several ways. For example, the PCD may be made from a thermally stable binder such as metal carbonate in a high pressure high temperature cycle. Alternatively, a catalyst/binder-sintered PCD may be at least partially leached in a subsequent step to remove the catalyst or binder material, such as cobalt, from the interstitial channels and the partially leached disc may be at least partially infiltrated with a non-binder material.

Figure 4:
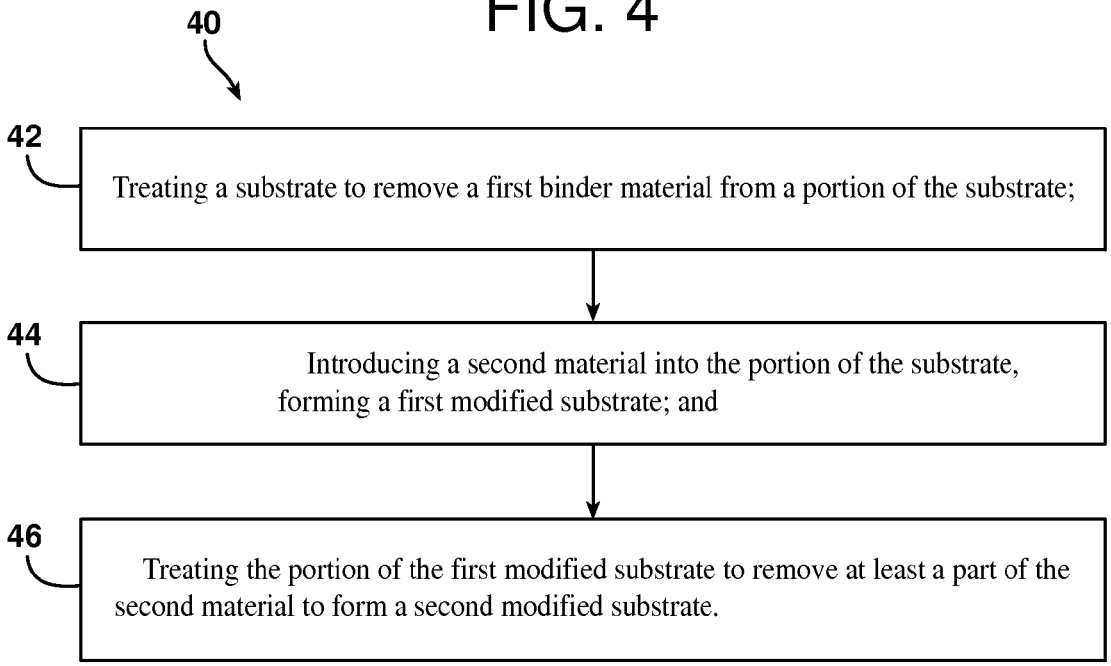
FIG. 4 is a flow chart illustrating a method of making a thermally stable polycrystalline diamond compact.
Figure 5:
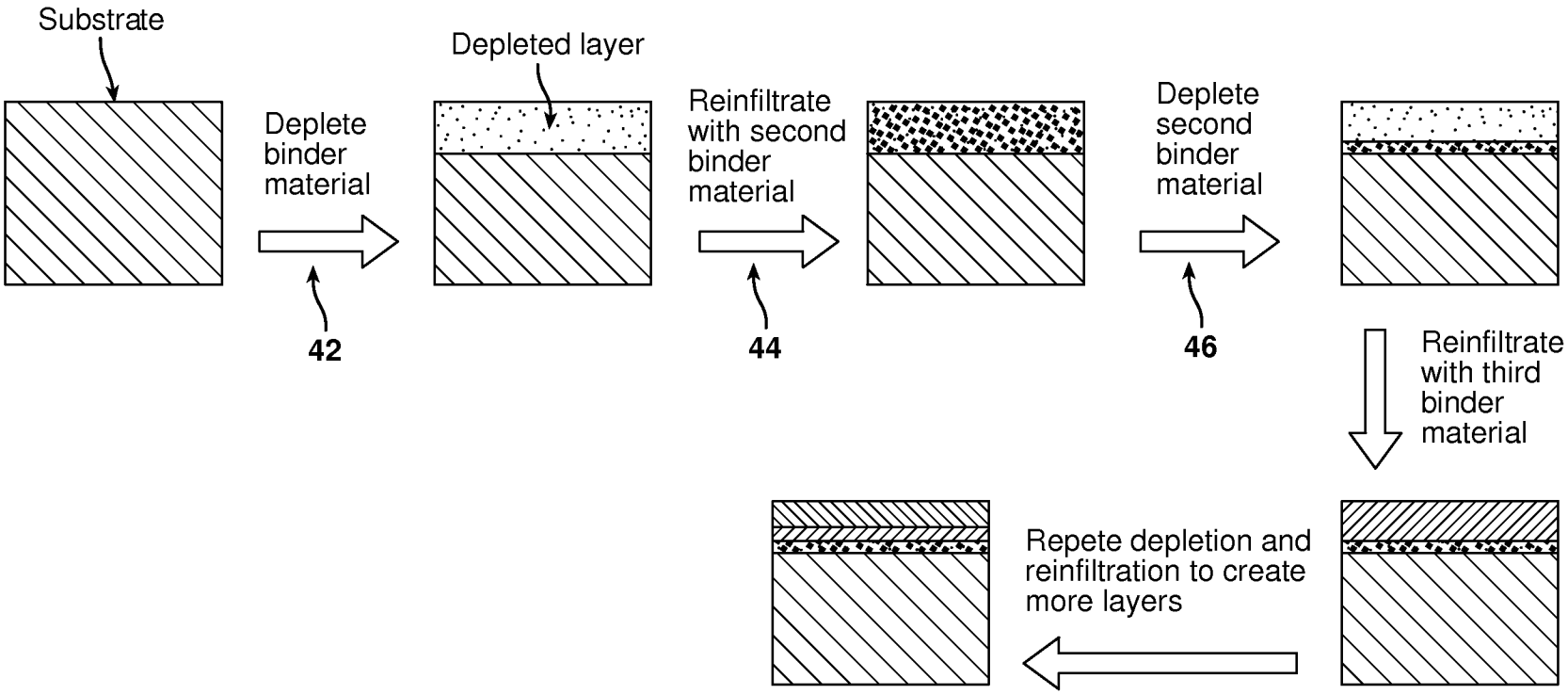
FIG. 5 is a schematic diagram showing cross-sectional views to illustrate the arrangement used in a sweep-through process according to an exemplary embodiment.

In one embodiment, as shown in FIGS. 4 and 5, a method 40 of making a superabrasive compact according to the present disclosure may comprise steps of treating a substrate 20, such as a cemented tungsten carbide, to remove a first binder material, wherein the first binder material comprises a metal selected from the group consisting of Co, Ni, Fe, and combinations thereof, from a portion of the substrate in a step 42; introducing a second material, such as a second binder material which may be Co, Ni, Fe, and combinations thereof or a braze alloy, such as Ticusil®, into the portion of the substrate, forming a first modified substrate in a step 44; and treating the portion of the first modified substrate to remove at least a part of the second material to form a second modified substrate in a step 46.

Figure 6:
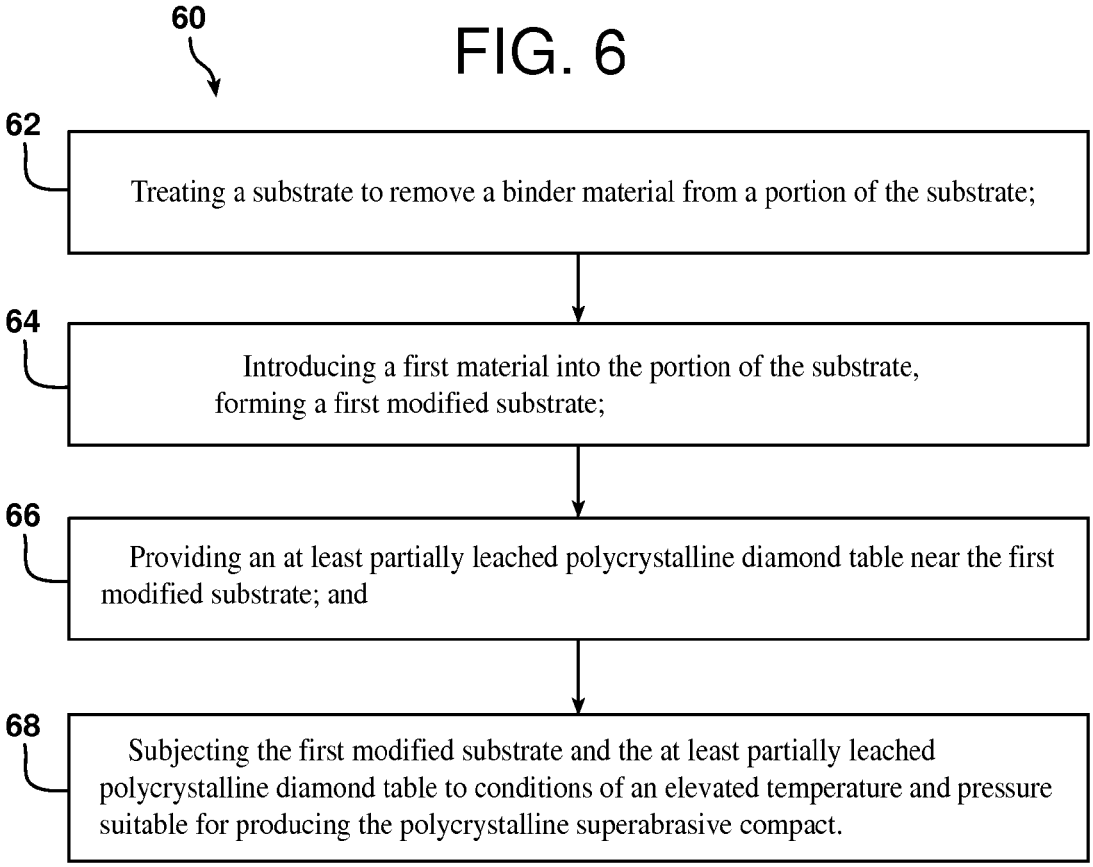
FIG. 6 is a flow chart illustrating a method of making a thermally stable polycrystalline diamond compact.
Figure 7:
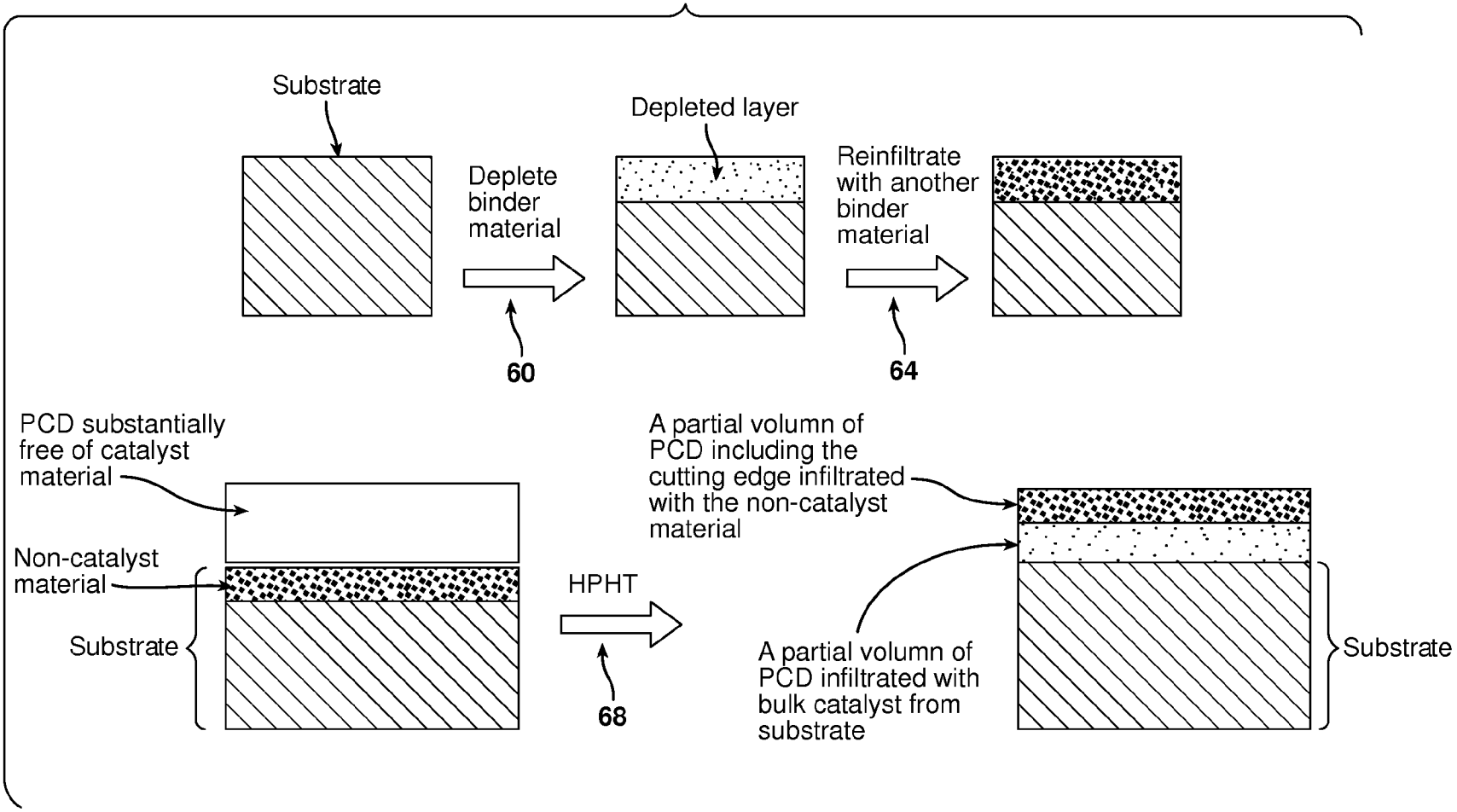
FIG. 7 is a schematic diagram showing cross-sectional views to illustrate the arrangement used in a sweep-through process according to an exemplary embodiment.

The method 40 may further comprise steps of providing an at least partially leached polycrystalline diamond table at a position near the second modified substrate; and subjecting the second modified substrate and the at least partially leached polycrystalline diamond table to conditions of an elevated temperature and pressure suitable for producing the polycrystalline superabrasive compact;

As shown in FIGS. 6 and 7, a method 60 of manufacturing a superabrasive compact may comprise steps of treating a substrate 20, such as a cemented tungsten carbide, to remove a binder material from a portion of the substrate in a step 62; introducing a first material into the portion of the substrate, forming a first modified substrate in a step 64; providing an at least partially leached polycrystalline diamond table near the first modified substrate in a step 66; and subjecting the first modified substrate and the at least partially leached polycrystalline diamond table to conditions of an elevated temperature and pressure suitable for producing the polycrystalline superabrasive compact 10 in a step 68.

The step 62 of removing the binder material from a portion of the substrate may include a step of the surface of a substrate being depleted of the binder material by a suitable process such as leaching with Lewis acid, such as $FeCl_3$, HF etc. Introduction or Infiltration of the first material in the step 64 may be carried out in a reducing or slightly carburizing atmosphere, depending on the specific composition of the carbide skeleton structure. The infiltrating material, in such forms as a powder, solid body, or foil, is raised to slightly above its melting point while in contact with the skeleton and then infiltrates by capillary action at about 1000° C.

In one embodiment, the first material may be selected from a variety of materials that are non-catalytic with the carbon-diamond conversion and include, for example and without limitations, metals, metal alloys, metalloids, semiconductors, and combinations thereof. The first material may be selected from one of copper, silver, gold, aluminum, silicon, gallium, lead, tin, bismuth, indium, thallium, tellurium, antimony, polonium, lithium, magnesium, and alloys thereof. In another embodiment, the first material may include silicon containing material. In yet another embodiment, the first material may include a brazing alloy, such TiCusil®. In a particular embodiment, the first material may include an aluminum containing material. In yet another embodiment, the first material may include a eutectic material comprising about 87.5% aluminum and about 12.5% silicon eutectic composition.

In certain embodiments, the aluminum containing material or silicon containing material may react with diamond to form aluminum carbide or silicon carbide at high temperature. The aluminum or silicon may keep moving toward cemented tungsten carbide up to the interface between the first region and the second region where the binder sweeps through from commented tungsten carbide. The first region may occupy from about 20% to up to about 95% volume of the at least partially leached polycrystalline diamond table.

By the time when the temperature reaches about 1200° C., the binder material, such as an iron group transitional metal, e.g., cobalt, nickel, or iron, from the cemented carbide substrate may sweep into the interstitial channels of the diamonds.

The composite material may be selected from a group consisting of as a powder, as a disk, as a ring, as a disk with perforated holes, as a triangle, as a rectangular. The method 60 may further include a step of bonding the substrate to the at least partially leached polycrystalline diamond table. Providing at least partially leached polycrystalline diamond table in a step 66 that comprises bonded diamond grains defining interstitial channels therein may further include a step of partially leaching the diamond table or fully leaching the diamond table.

One or more steps may be inserted in between or substituted for each of the foregoing steps 62-68 without departing from the scope of this disclosure.

Figure 8:
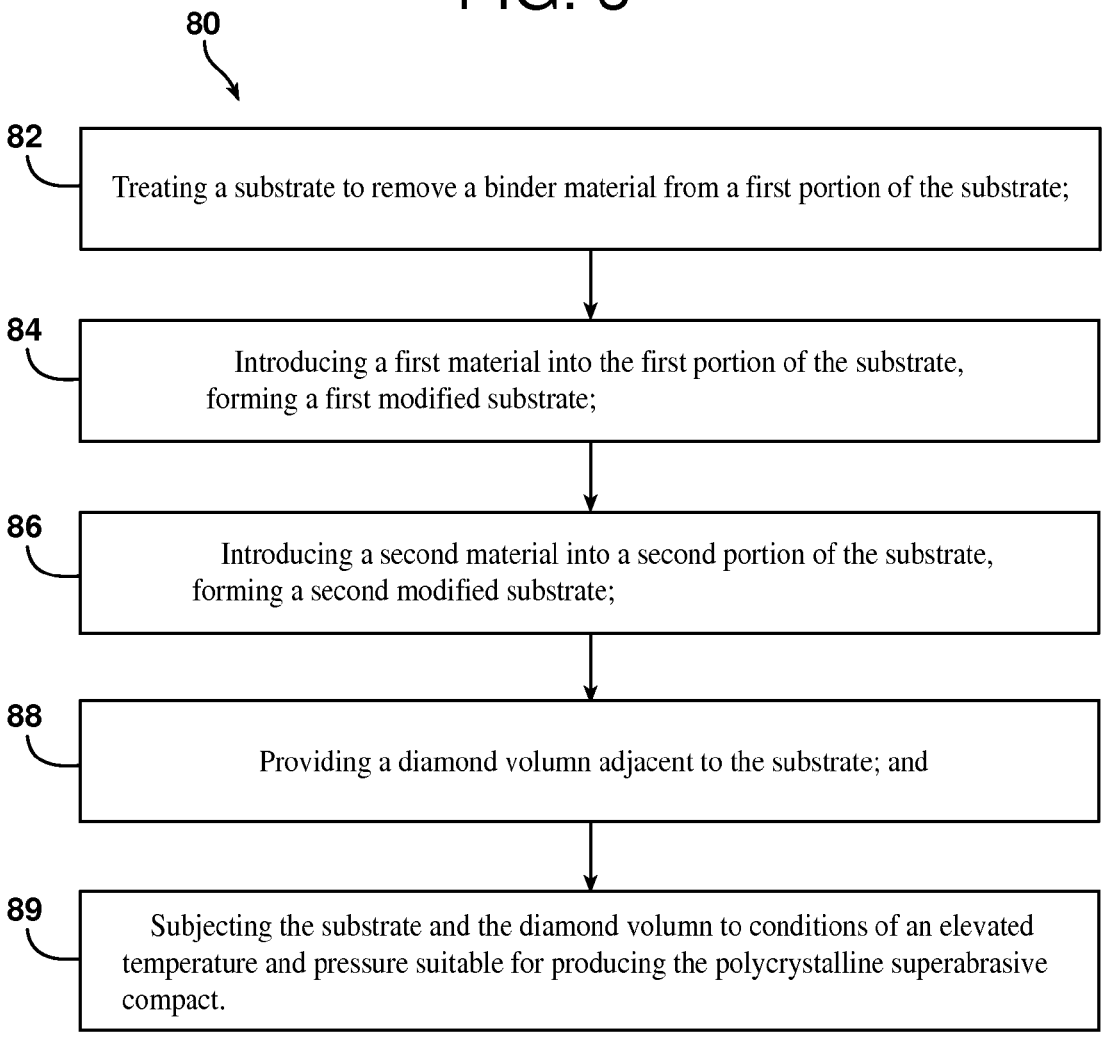
FIG. 8 is a flow chart illustrating a method of making a thermally stable polycrystalline diamond compact.
Figure 9:
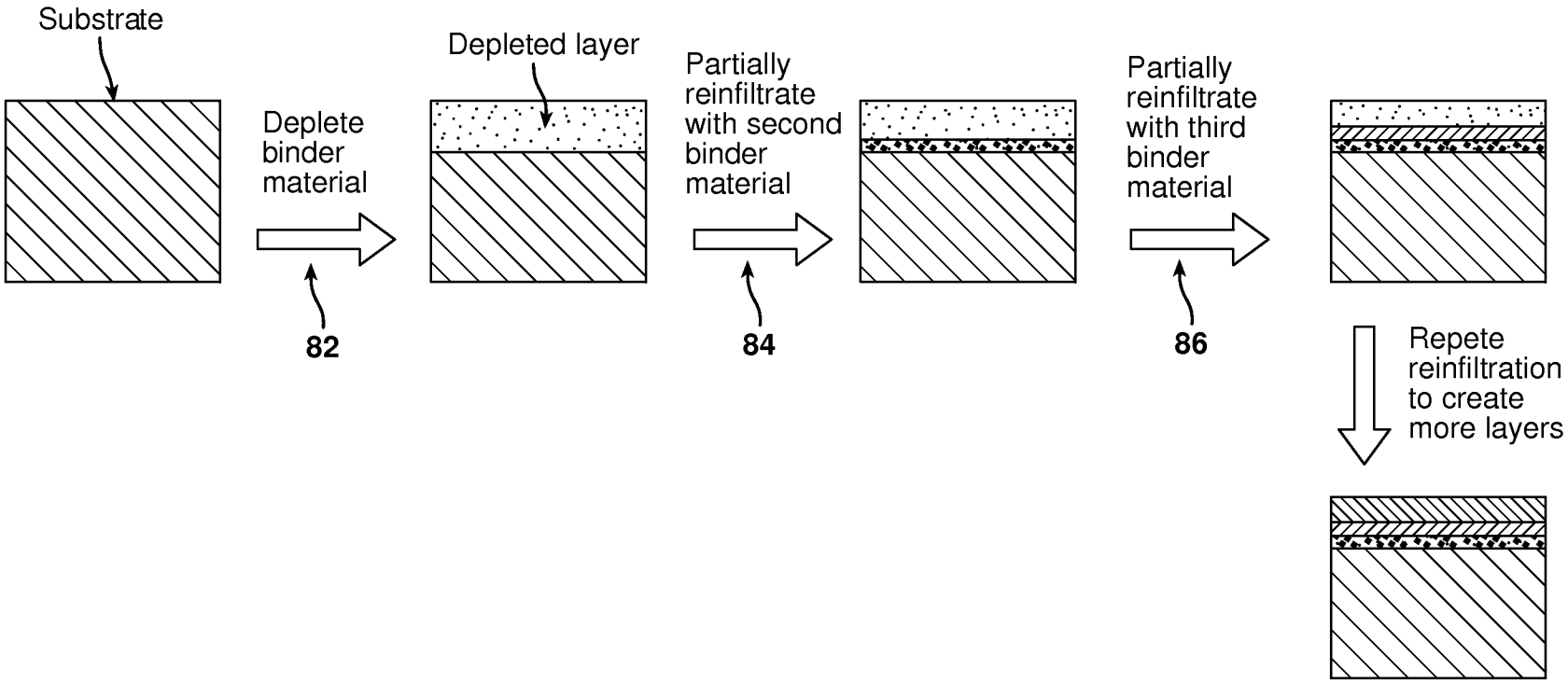
FIG. 9 is a schematic diagram showing cross-sectional views to illustrate the arrangement used in a sweep-through process according to an exemplary embodiment.

In another embodiment, as shown in FIGS. 8 and 9, a method 80 of making a superabrasive compact may include steps of treating a substrate to remove a binder material from a first portion of the substrate in a step 82; introducing a first material into at least a first part of the first portion of the substrate, forming a first modified substrate in a step 84; introducing a second material into at least a second part of the first portion of the substrate, forming a second modified substrate in a step 86; providing a diamond volume, such as a plurality of diamond powder or a thermally stable polycrystalline diamond, adjacent to the substrate in a step 88; and subjecting the substrate and the diamond volume to conditions of an elevated temperature and pressure suitable for producing the polycrystalline superabrasive compact in a step 89.

The method 80 may further comprise steps of reinfiltrating the diamond volume with the second material followed by infiltrating the first material from the substrate; reinfiltrating a third material into at least a third part of the first portion of the substrate, forming a third modified substrate before providing a diamond volume adjacent to the substrate; reinfiltrating a fourth material into at least a fourth part of the first portion of the substrate, forming a fourth modified substrate before providing a diamond volume adjacent to the substrate; lapping off a part of the diamond volume.

In one embodiment of the method 80, the binder material may comprise a metal selected from the group consisting of Co, Ni, Fe, and combinations thereof. The second, third, or fourth material may be the same composition as the first binder material in the substrate. In another embodiment of the method 80, the second, third, or fourth material may be a second binder material different from the first binder material in the substrate.

If the modified substrate has several layers of infiltrated binder material, the different layers may be introduced sequentially into interstitial spaces in the PCD volume. Alternatively, the layers may form compounds or alloys during the bonding process and the resulting material will be introduced into interstitial spaces of the PCD. The thickness of the infiltrated layer or layers may be chosen so as to control the infiltration depth of various binder materials into the PCD.

Reinfiltration may occur by solid state diffusion of the cement. One of the objects may be to produce a gradient in cement concentration from the main body through the skeletal hard metal. It may be preferred to use the lower temperatures within this range, thereby avoiding possible eutectic temperatures at which reinfiltration possibly would no longer be by solid state diffusion. It will be appreciated that the specific conditions used for cement reinfiltration will vary depending upon the actual composition involved, and that suitable sintering conditions to accomplish this for a particular practice can readily be chosen by the artisan.

Example 1

A sintered tungsten carbide substrate was leached in boiling hydrochloric acid at about 100° C. for 3 hours. Leaching process resulted in from 250 to 300 micrometers of a leached region depleted of cobalt and extending away from the surface of the substrate. The substrate was then cleaned in DI water and dried. The leached substrate was then infiltrated with a braze alloy according to the following process: a 0.002" thick foil of braze alloy was placed adjacent to the leached surface of the substrate. A tantalum disc was placed on top of the braze alloy foil. The assembly was enclosed inside a sleeve to keep the parts aligned. The infiltration cycle included preheating to 250° C. for 30 min in argon, then heating to 920° C. in hydrogen atmosphere for 20 min. The braze alloy melted and infiltrated into the leached region of the substrate. After infiltration, the tantalum disc and any residual braze alloy on the surface of the substrate was ground off such that the substrate had a desired thickness of the infiltrated layer. This process thus resulted in a uniform and continuous tungsten carbide matrix with two separate regions containing different materials having different melting point. There may potentially have been some alloying between the two different materials at their interface.

The substrate was then used in an experiment where a leached polycrystalline diamond disc was placed against the substrate and subjected to a high pressure and high temperature process at about 75 kbar and 1460° C. At HPHT, the infiltrated braze alloy melted and swept into the pores of the leached diamond disc. After HPHT, there was a gradient in the braze alloy concentration—more weight percent of braze alloy at positions proximate to the top of the substrate and less weight percent of the braze alloy at positions proximate to the bottom of the substrate. A gradient of cobalt in the opposite direction was also observed. The braze alloy had alloyed with cobalt to some extent and lowered the melting point of the resulting mixture, thus enabling the resulting mixture to sweep at a lower temperature than the melting temperature of cobalt. SEM images and elemental maps taken at the interface between the substrate and polycrystalline diamond show that the cobalt from the substrate has swept into and occupied the previously leached and reinfiltrated region while the braze alloy from that region has swept into the diamond disc.

Example 2

The substrate was prepared as in Example 1 where a leached polycrystalline diamond disc was placed between the substrate along one side of the polycrystalline diamond disc and an aluminum foil along the other side of the polycrystalline disc and subjected to a high pressure and high temperature process at about 75 kbar and 1550° C. The thickness of the aluminum foil was selected such that aluminum would partially infiltrate the diamond disc at HPHT. At HPHT, aluminum infiltrated from one side of the polycrystalline diamond disc and the braze alloy infiltrated from the other side of the disc.

While reference has been made to specific embodiments, it is apparent that other embodiments and variations can be devised by others skilled in the art without departing from their spirit and scope. The appended claims are intended to be construed to include all such embodiments and equivalent variations.

The invention claimed is:

1. A method of making a superabrasive compact, comprising:

treating a substrate to remove a first binder material from a portion of the substrate to form a first region depleted of binder material;

introducing a second material into the first region depleted of binder material, forming a first modified substrate; and treating the first modified substrate to remove at least a portion of the second material from the first region to form a second region depleted of second material, forming a second modified substrate.

2. The method of the claim 1, further comprising providing an at least partially leached polycrystalline diamond table near the second modified substrate.

3. The method of the claim 2, further comprising subjecting the second modified substrate and the at least partially leached polycrystalline diamond table to conditions of an elevated temperature and pressure suitable for producing the polycrystalline superabrasive compact.

4. The method of the claim 1, wherein the second material is a second binder material.

5. The method of the claim 1, wherein the first binder material comprises a metal.

6. The method of the claim 1, wherein the second material is a braze alloy.

7. The method of the claim 1, wherein the second material is a silicon-containing material.

8. The method of the claim 1, wherein the second material is an aluminum-containing material.

9. A method of making a superabrasive compact, comprising:

treating a substrate to remove a binder material from a portion of the substrate to form a first region depleted of binder material;

introducing a first material into at least a first part of the first region depleted of binder material, forming a first modified substrate;

providing an at least partially leached polycrystalline diamond table near the first modified substrate; and subjecting the first modified substrate and the at least partially leached polycrystalline diamond table to conditions of an elevated temperature and pressure suitable for producing the polycrystalline superabrasive compact, wherein the first material includes at least one of a silicon-containing material and an aluminum-containing material.

10. The method of the claim 9, further comprising introducing a second material into at least a second part of the first region depleted of binder material.

11. The method of the claim 9, wherein the binder material comprises a metal selected from the group consisting of Co, Ni, Fe, and combinations thereof.

12. The method of the claim 9, wherein the first material is a silicon-containing material.

13. The method of the claim 9, further comprising infiltrating the first material from the first modified substrate into a first region of the at least partially leached polycrystalline diamond table.

14. The method of the claim 9, further comprising infiltrating the binder material from the first modified substrate into a second region of the at least partially leached polycrystalline diamond table.

15. The method of the claim 13, wherein the first region occupies from about 20% to up to about 95% volume of the at least partially leached polycrystalline diamond table.

16. The method of the claim 9, wherein the first material is an aluminum-containing material.

17. The method of the claim 9, wherein the first material is a braze alloy.

18. The method of the claim 13, further comprising forming a carbide material between the first material and the diamond when the first material infiltrates into the first region of the at least partially leached polycrystalline diamond table.

19. A method of making a superabrasive compact, comprising:

treating a substrate to remove a first binder material from a first portion of the substrate;

introducing a first material into at least a first part of the first portion of the substrate, forming a first modified substrate;

introducing a second material into at least a second part of the first portion of the substrate, forming a second modified substrate;

providing a diamond volume adjacent to the substrate;

subjecting the substrate and the diamond volume to conditions of an elevated temperature and pressure suitable for producing the polycrystalline superabrasive compact; and reinfiltrating the diamond volume with the second material followed by infiltrating the first material from the substrate.

20. The method of the claim 19, wherein the diamond volume is a plurality of diamond powder.

21. The method of the claim 19, wherein the diamond volume is a thermally stable polycrystalline diamond.

22. The method of the claim 19, wherein the first binder material comprises a metal selected from the group consisting of Co, Ni, Fe, and combinations thereof.

23. The method of the claim 19, further comprising reinfiltrating a third material into at least a third part of the first portion of the substrate, forming a third modified substrate before providing the diamond volume adjacent to the substrate.

24. The method of the claim 23, further comprising reinfiltrating a fourth material into at least a fourth part of the first portion of the substrate, forming a fourth modified substrate before providing the diamond volume adjacent to the substrate.

25. The method of the claim 24, wherein the fourth material is a binder material.

26. The method of the claim 23, wherein the third material is a second binder material.

27. The method of the claim 25, further comprising lapping off a part of the diamond volume.

* * * * *